US006499562B1

(12) United States Patent
Elfinger et al.

(10) Patent No.: US 6,499,562 B1
(45) Date of Patent: Dec. 31, 2002

(54) MUFFLER WITH VARIABLE SOUND-ABSORBING CHARACTERISTICS

(75) Inventors: Gerhard Elfinger, Ilmmuenster (DE); Wolfgang Hahnl, Grimma (DE); Friedrich Wellner, Holzheim (DE); Andreas Mayr, Meitingen (DE); Klaus Spindler, Aystetten (DE); Thomas Koehler, Gessertshausen (DE); Hans Bussmann, Laugna (DE)

(73) Assignee: Zeuna-Staerker GmbH & Co. KG, Augsburg (DE)

( * ) Notice: Subject to any disclaimer, the term of this patent is extended or adjusted under 35 U.S.C. 154(b) by 0 days.

(21) Appl. No.: 09/607,115

(22) Filed: Jun. 29, 2000

(30) Foreign Application Priority Data

Jul. 29, 1999 (DE) ..... 199 35 711

(51) Int. Cl.[7] ..... F01N 1/02

(52) U.S. Cl. ..... 181/251; 181/254; 181/272; 181/275

(58) Field of Search ..... 181/251, 254, 181/237, 268, 269, 272, 275, 249

(56) References Cited

U.S. PATENT DOCUMENTS 4,484,659 A * 11/1984 Buchwalder ..... 181/266
5,709,241 A * 1/1998 Iwata ..... 137/527.6
5,739,483 A * 4/1998 Yashiro et al. ..... 181/254
5,744,762 A * 4/1998 Seki et al. ..... 181/254
5,821,474 A * 10/1998 Olszok et al. ..... 181/254
5,984,045 A * 11/1999 Maeda et al. ..... 181/254

FOREIGN PATENT DOCUMENTS

JP 06088514 A * 3/1994 ..... 181/213
JP 06088515 A * 3/1994 ..... 181/230

* cited by examiner

*Primary Examiner*—Robert E. Nappi
*Assistant Examiner*—Edgardo San Martin
(74) *Attorney, Agent, or Firm*—Katten Muchin Zavis Rosenman

(57) ABSTRACT

A muffler for pulsating gases, especially exhaust gases of internal combustion engines, comprises a housing into which an inlet conduit enters, from which at least on outlet conduit exits and which is divided by at least one partition wall into at least two chambers. In this muffler the flow cross section of a flow path connecting two chambers and/or of an outlet conduit can be varied by means of an adjustable closure element. An actuating element acting on the closure element is provided in the region of the exit cross section of the inlet conduit.

8 Claims, 3 Drawing Sheets

MUFFLER WITH VARIABLE SOUND-ABSORBING CHARACTERISTICS

CROSS REFERENCE TO RELATED APPLICATIONS

None.

STATEMENT REGARDING FEDERALLY SPONSORED RESEARCH OR DEVELOPMENT

None.

REFERENCE TO MICROFICHE APPENDIX

None.

BACKGROUND OF THE INVENTION

1. Field of the Invention

The invention relates to a muffler and more particularly to mufflers for pulsating gases, especially exhaust gases of internal combustion engines with variable sound absorbing characteristics!

2. Description of Related Art including information disclosed under 37 CFR 1.97 and 1.98.

The invention relates to a muffler according to the preamble of claim 1. It therefore relates to mufflers for pulsating gases, especially exhaust gases of internal combustion engines, with variable sound-absorbing characteristic.

Legal noise reduction requirements are being introduced increasingly in all walks of life. This is particularly true for motor vehicles powered by internal combustion engines. The considerable improvement of sound absorption required for this application, even in the low speed range, is leading to longer flow paths inside the muffler system and thus to greater flow resistances. The greater energy expenditure must be supplied by the engine. To counter these drawbacks, the flow cross sections available to the pulsating gas must be increased, but the costs for the exhaust-gas system are greater for larger muffler volume. These circumstances are inconsistent with the challenge to the automobile manufacturers, which is to lower costs and decrease the size of the installation space.

One approach to resolving this conflict of objectives was proposed in the paper entitled "Active sound absorption—Possibilities for variable modulation of discharge noise" [in German] (MTZ Motortechnische Zeitschrift 53 (1992) No. 7/8 p. 3). It relates to a rear muffler with two tailpipes. A closure element in the form of a throttle valve is disposed in one of the two tailpipes. This valve is closed when the engine is running at low speed. The exhaust gas flows along a longer flow path. Part of the muffler volume acts as a Helmholtz chamber. When the closure element is open, the exhaust gas flows through both tailpipes. The ratio of the pressure losses, frequently also known as backpressures, with the closure element closed and open corresponds approximately to the square of the reciprocal of the ratio of the free flow areas. The closure element is connected via a crank mechanism and a rod to a pressure cell as the actuating element. This negative-pressure cell is actuated via a control system comprising solenoid valve, vacuum accumulator, nonreturn valve and connecting lines by the intake section of an internal combustion engine, where negative pressure prevails. A control unit which evaluates the engine speed and the throttle-valve position acts on the solenoid valve.

Numerous further proposed solutions for mufflers with variable sound-absorbing characteristic have been formulated. They can be divided into two main groups, which are referred to as externally controlled and autonomous solutions depending on whether the signal for controlling the closure element originates from outside or from inside the muffler.

The example described in the introduction and those of DE-OS 4416739 and DE-OS 3835079 correspond to externally controlled solutions. Such solutions are also found as shutoff valves in other portions of an exhaust-gas system (see, for example, DE 19630164 A1 or DE 9413493 U1). These solutions have the advantage that switching processes can be initiated highly selectively and operate relatively independently of the flow processes in the muffler. A disadvantage of externally controlled solutions is that the switching element can be disposed for the most part only on one tailpipe, outside the muffler. In view of its heat resistance, the pneumatically operated actuating element has only a limited service range. A further critical disadvantage is found in the large number of necessary components: 1. The control system comprises solenoid valve, vacuum accumulator, nonreturn valve and connecting lines. 2. The actuating element is assembled from a diaphragm, housing and spring. 3. A gear mechanism converts the reciprocating motion into pivoting motion. 4. The closure element comprises a shaft, bearing arrangement and gasket ring. In addition, a secondary energy source such as a pneumatic system is needed.

To overcome these disadvantages, autonomous solutions have been proposed. These use selected flow parameters inside a muffler in order to initiate the switching process.

Directly controlled systems rely on the concept, known from reciprocating pump and compressor design, of directly activating valves by fluid flow. Thus they directly utilize the gas stream to be influenced for actuation of the closure element; the actuating element and closure element are combined. Pertinent prior art can be found in particular in DE 19729666 A1, WO 95/13460, DE 19520157 A1, DE 19720410 A1, DE 19540716 C1, DE 19503322 A1, U.S. Pat. Nos. 5,821,474, 5,801,343, 5,739,483, 5,723,827, 5,709,241, 5,708,237, 5,614,699, 4,971,166, 4,484,569, EP 0902171 A1, DE 9207838.9 U1, DE 9405771.0 U1, DE 9406200.5 U1, DE 29803183 U1. Usually spring elements (WO 95/13460) or/and magnets (DE 19520157 A1) are used to generate the restoring forces. The proposed solutions have a critical disadvantage: in general they do not permit stable operating behavior.

When the closure element in one of the parallel flow paths is closed, a relatively large pressure drop develops, depending on the resistance of the free flow path. If the force from the pressure difference is larger than the force of the spring holding the closure element closed, the closure element opens the second flow path. The differential pressure decreases immediately the further the second flow path is released. The opening force vanishes. The spring opposing the force of pressure causes the previously released flow path to close. The useful life of the system is adversely influenced by these unstable switching conditions.

Even systems with all components involved favorably matched, such that the closure elements can occupy intermediate positions depending on flow condition, are not free of disadvantages. In contrast to the externally controlled systems, they must satisfy the prerequisite of a well defined pressure drop in order that a switching process can be initiated. This also explains their poorer acoustic effect, however, compared with externally controlled systems. Bistable switching positions are difficult to adjust. The variability of the acoustic system is limited. In addition, some of the proposed solutions are technically complex.

A more advantageous solution appears to be one proposed in DE 19619173 C1. The incoming flow to the muffler takes place via a venturi nozzle. A negative pressure is generated in the narrowest cross section and, via connecting lines, acts on one side of a pneumatic switching element. The pressure in the inlet conduit upstream from the venturi nozzle acts on the other side. The pressure difference causes opening of the closure element.

Since on the one hand the total mass flow of the incoming flow is used to establish the negative pressure in the venturi nozzle and on the other hand the positive pressure in the inlet conduit upstream from the venturi nozzle is used to open the closure element, although the closure element releases precisely this positive pressure region as the flow path, this solution can be classified among the semi-directly acting systems. This classification will become clearer upon closer examination of the mechanism of action. Upon release of the second flow path upstream from the venturi nozzle, the total pressure difference vanishes, as is necessary to accelerate the exhaust gas to a velocity sufficient to generate negative pressure in the venturi nozzle.

Even in this solution the instability explained hereinabove is not eliminated. Furthermore, extremely high velocities must be achieved in the venturi nozzle in order to establish the necessary negative pressure. As is known, high velocities lead to undesired hydrodynamic noise.

U.S. Pat. Nos. 5,744,762, 5,723,829 and EP 0733785 A2 describe proposed solutions with indirect control. The static (U.S. Pat. No. 5,723,829) or dynamic plus static (U.S. Pat. No. 5,744,762 and EP 0733785) positive pressure in the muffler acts via a tubular line on an externally disposed piston, which actuates a throttle valve via a crank mechanism. With increasing positive pressure the piston is displaced in longitudinal direction, and the throttle valve opens a second flow path. This solution also is highly complex, and does not allow for the fact that, with release of the second flow path, the internal pressure in the muffler also decreases and thus acts against the intended process of opening of the throttle valve.

The technical solutions which guarantee good acoustic functionality are extremely complex. They need an extensive control system, actuating elements which are alternately loaded pneumatically and by spring action, and a gear mechanism for motion transmission. When functional elements are combined, either they become very complex or they lead to flow conditions which are unstable or/and act in opposing manner. Furthermore, the geometric options of the muffler are limited.

A need therefore exists for a muffler with variable sound-absorbing characteristic which resolves the conflict of objectives described in the introduction, which corresponds in its acoustic effect to externally controlled systems and which nevertheless has a more cost-effective and weight-saving design comprising few components.

The object of the invention is to provide a muffler of the class in question with variable sound-absorbing characteristics, the switching elements of which operate without external control and without secondary energy sources, exhibit only slight structural complexity and cause only small pressure losses, wherein the arrangement of components does not cause opposing effects but permits bistable operating conditions and simultaneously a large diversity of alternative configurations based on the boundary conditions of acoustics, geometry and hydrodynamics, which muffler can be equipped with one or two tailpipes if necessary depending on the customer's wish.

BRIEF SUMMARY OF THE INVENTION

According to the invention, the object is achieved by a muffler, for pulsating gases, especially exhaust gases of internal combustion engines. The muffler comprises a housing into which an inlet conduit enters and at least one outlet conduit exits and is divided by at least one partition wall and at least two chambers. The flow cross section of a flow path connecting chambers and/or of an outlet conduit is variable by an adjustable closure element. An actuating element acts on the closure element and is downstream from the exit cross section of the inlet conduit. The actuating element comprises a movable plate-type element upon which the pulsating gas is incident.

According to the invention, the object is achieved by a muffler with the features of claim 1.

A closure element for varying the sound-absorbing characteristic is also used in the present invention. The closure element is associated with one of two parallel flow paths. When the closure element is open, both flow paths are released, but when it is closed, the exhaust gas flows only via one flow path.

This closure element is associated either with a second tailpipe or with an internal flow conduit of the muffler, especially an inner pipe or an opening of a partition wall. The closure element is moved by an actuating element.

According to the invention, the actuating element is disposed in the region of the exit cross section of the inlet conduit. In an especially preferred embodiment it is disposed at a distance downstream from the exit opening of the inlet conduit. The closure element and actuating element are connected pivotally to one another via a gear mechanism, preferably via a common shaft. According to a preferred improvement of the invention, the actuating element can then have the form of a plate-type element, which in particular can be plane, convex or angled.

The principle of operation of the invention is as follows:

The exhaust-gas stream flows without being split through the inlet conduit. It is only in this arrangement that the exhaust-gas stream can be correlated with the engine speed. The pressure level in the muffler then plays a subordinate role. A restoring device holds the actuating element in a first rest position at low engine speed and thus low exhaust-gas mass flow. In this rest position the closure element closes the second flow path in the muffler or closes the second tailpipe. In this position the muffler has better sound-absorbing properties than when the closure element is open. The exhaust gas flows without hindrance around the actuating element, without actuating or even substantially influencing it.

As the engine speed becomes greater, the exhaust-gas mass flow increases commensurately. The velocity-dependent forces (impulse force, drag force and buoyant force) also increase.

Tests have shown that there exists a medium engine-speed range which from the viewpoint of switching technology can be regarded as the transition region. In this transition region it is immaterial whether the closure element is open or closed. This transition region extends over a speed range of about 300 to 500 rpm and begins at an engine speed of about 2500 rpm in the case of the test arrangement used. Above this region the muffler has better sound-absorbing properties with the closure element open.

The initial tension of a restoring device, preferably in the form of a spring element, is preferably chosen such that the actuating element occupies its first rest position under the transition region. The spring constant is expediently adjusted such that the actuating element occupies its second rest position above the transition region and the closure element releases the second flow path.

Depending on the actual configuration of the muffler—which is guided not only by the engine-specific characteristics but also by the geometric free space in the bottom region of a motor vehicle as well as by the customer's wishes—free choice of the hydrodynamic forces acting on the actuating element is also advantageously possible. If impulse force is chosen, the actuating element can be constructed as a plane plate-type element. If it is wished to intensify the impulse force, the plate-type element can be provided with a deflector plate. The deflector plate can be fastened directly on the actuating element such that it is disposed at a specified distance therefrom. In one advantageous construction a cylindrical deflector plate is used. This surrounds the actuating element. The flow follows the movement of the actuating element.

A further preferred arrangement provides an actuating element with aerodynamic surface profile. In the first rest position the drag force acts on the actuating element, and in its second rest position the buoyant force acts thereon. The buoyant force can be intensified by disposing at a distance from the second rest position, parallel to the plate-type element having airfoil-like convexity or a curved surface of the actuating element, a deflector plate such that the gas flowing between actuating element and deflector plate generates a negative pressure and holds the actuating element stably in the second position. It is also possible to shape the actuating element as the blade of a turbine, preferably of a Pelton turbine. In this way the impulse force can be efficiently utilized.

A further preferred construction of the actuating element provides for equipping it with openings. The exhaust gas moves partly through and around the actuating element, creating a drag force. With increasing incident velocity the drag force increases, until the actuating element leaves the first rest position and moves to the second end position.

Pressure oscillations superposed on the main flow pass without being influenced through the openings in the actuating element and/or the free surface between it and the exit cross section of the inlet conduit.

The advantages of the inventive solution are that fluctuations not caused primarily by the typical principle of operation of an internal combustion engine (pulsations) are eliminated.

The gear mechanism which transmits the movement of the actuating element to the closure element is advantageously constructed as a simple shaft. Nevertheless, different forms of movement transmission can be designed depending on application. For example, it may be advantageous to mount the actuating element and closure element separately and to bring about movement in opposite directions via a toothed gear or lever-type linkage.

The ensemble of actuating element, gear mechanism, preferably a common shaft, closure element and restoring device has very simple structure, few moving parts and low weight, and permits an extremely variable configuration of the muffler.

BRIEF DESCRIPTION OF SEVERAL VIEWS OF THE DRAWINGS

Practical examples of the invention will be explained in more detail hereinafter with reference to drawings, wherein.

DETAILED DESCRIPTION OF THE INVENTION

Figure 1:
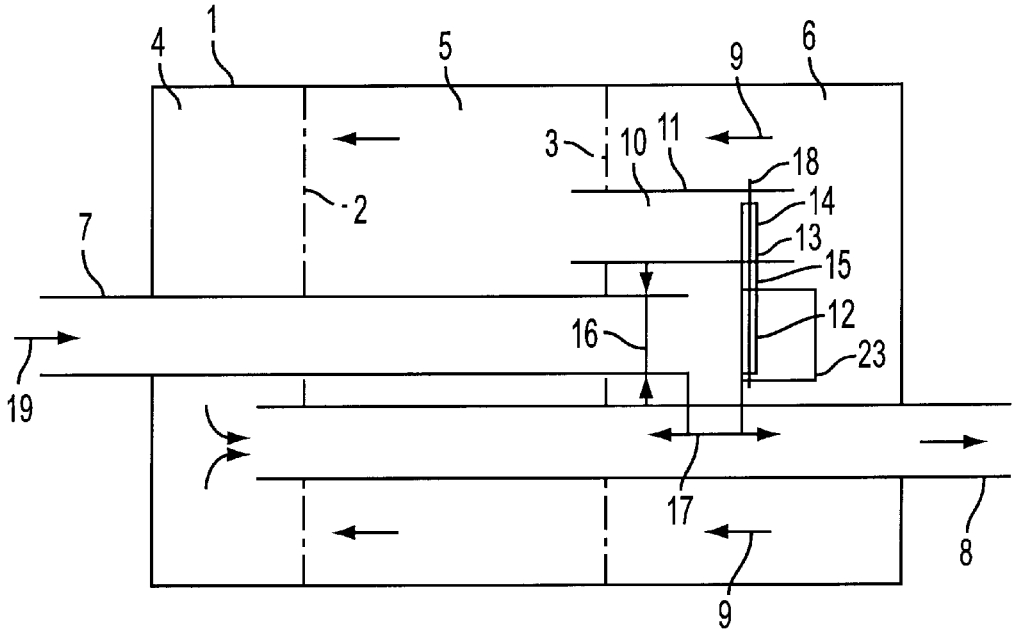
FIG. 1 shows a muffler with variable sound-absorbing characteristic at low exhaust-gas mass flow in sectional view.
Figure 2:
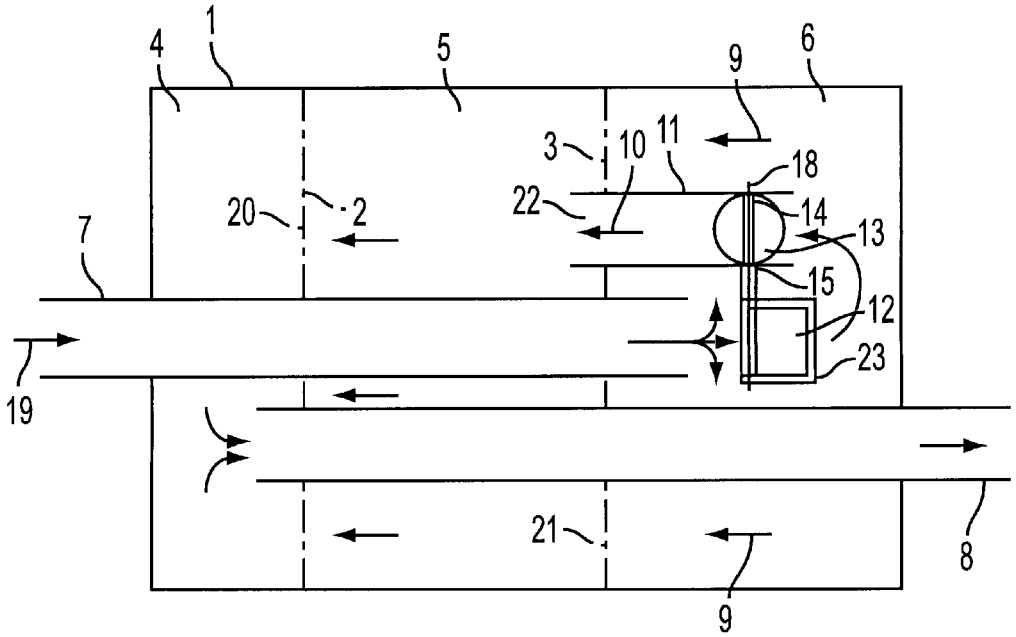
FIG. 2 shows the muffler according to FIG. 1 with high gas flowrate.
Figure 3:
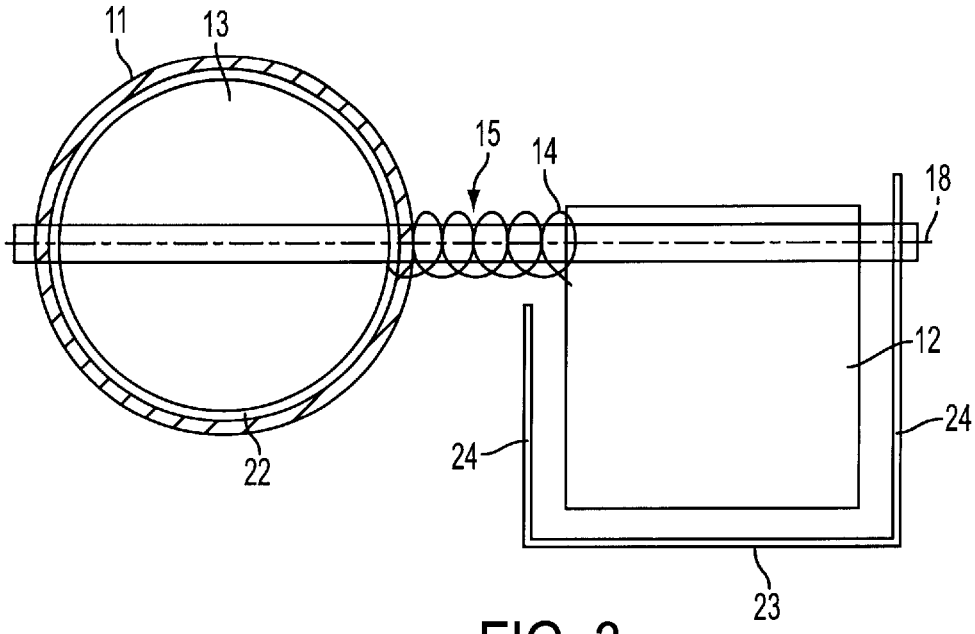
FIG. 3 shows the arrangement of closure element, shaft, spring and actuating element used in FIG. 1.
Figure 4:
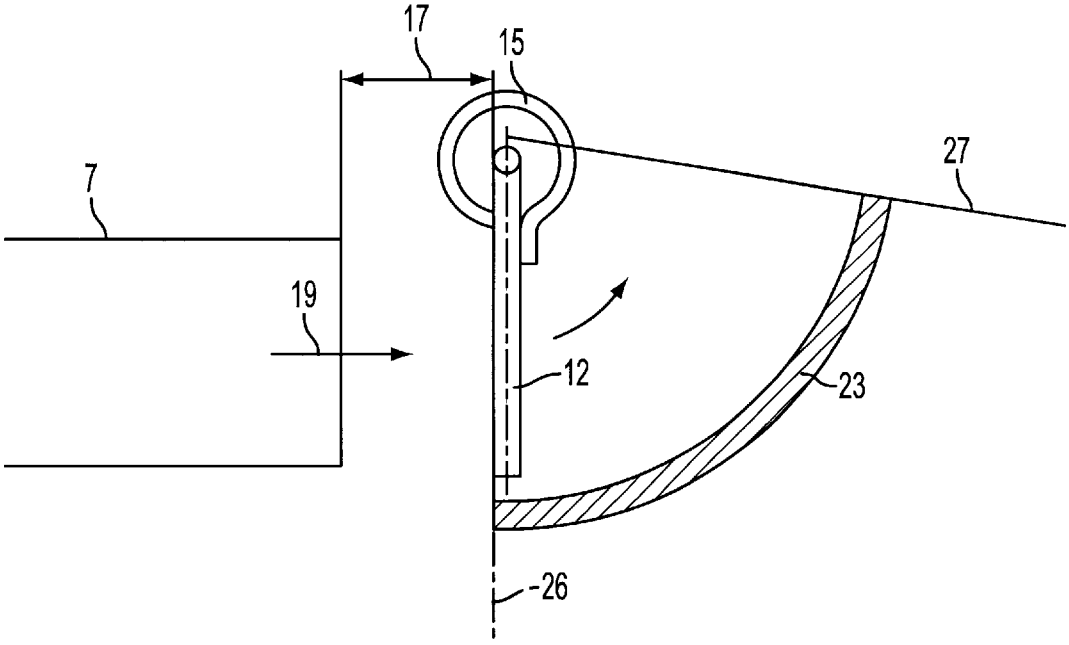
FIG. 4 shows an actuating element surrounded by a cylindrical deflector plate.

Practical examples of the invention will be explained in more detail hereinafter with reference to drawings, wherein FIGS. 1 and 2 show a first practical example of a muffler with variable sound-absorbing characteristic comprising a housing 1, partition walls 2, 3 provided with openings 20, 21, 22, chambers 4, 5, 6 formed by the said walls, an inlet conduit 7, a tailpipe 8, an inner pipe 11, an actuating element 12, a closure element 13 and a restoring element 15 in the form of a spring.

The flow paths of the exhaust gas are the following:

The exhaust gas flows via an inlet conduit 7 into chamber 6. Starting from this point two flow paths 9, 10 extend via chamber 5 to chamber 4 and from here into tailpipe 8. If closure element 13 blocks free opening 22 of inner pipe 11, the exhaust gas travels only along flow path 9 via opening 21 in partition wall 3 to chamber 5 and then via opening 20 of partition wall 2 into chamber 4.

If closure element 13 releases opening 22 of inner pipe 11, the exhaust gas can also use flow path 10 and flow from chamber 6 via chamber 5 into chamber 4.

The possibility exists of lengthening inner pipe 11 such that the exhaust gas enters chamber 4 directly. Thus the flow resistance created by openings 20 in partition wall 2 is bypassed.

FIG. 1 shows the muffler with closure element 13 closed and FIG. 2 shows it with closure element 13 open.

Actuating element 12, illustrated as a plate-type element in the form of a plane plate in FIGS. 1 to 4, is surrounded by a cylindrical deflector device 23 and by two side walls 24. Cylindrical deflector device 23 and side walls 24 have the task of matching the flow to the moving plate-type element 12.

Figure 5:
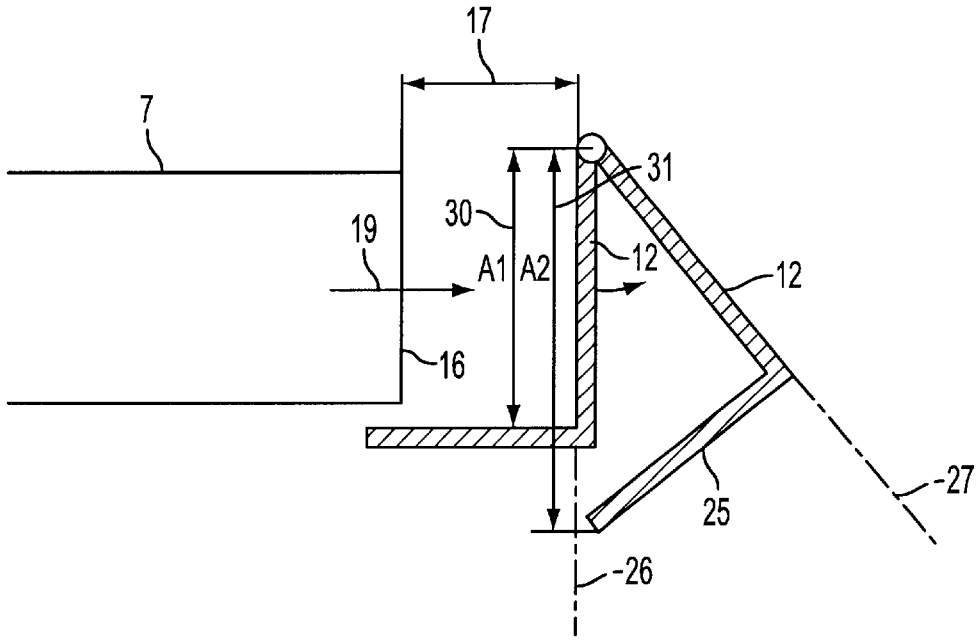
FIG. 5 shows an actuating element bent over at right angles.

Actuating element 12 provided with a bent-over edge 25 in FIG. 5 acts in such a way that, when bent-over edge 25 is adequately dimensioned, incident area 30 of actuating element 12 is enlarged to incident area 31 during the transition from first rest position 26 to rest position 27. Simultaneously, the resistance of actuating element 12 also increases.

Figure 6:
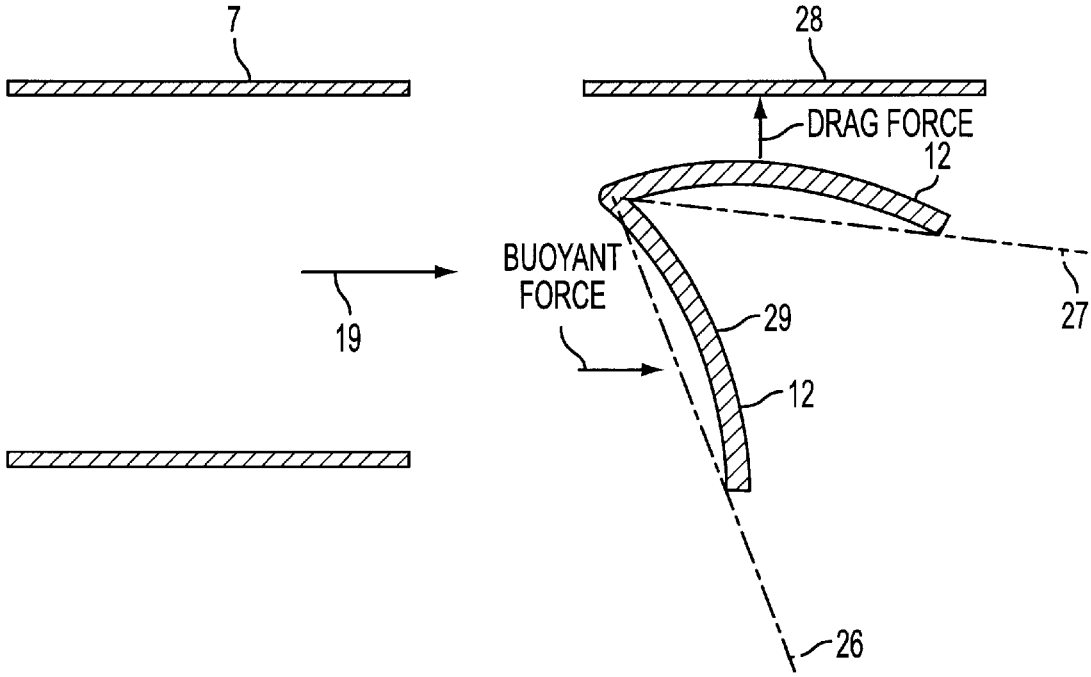
FIG. 6 shows an actuating element in curved form and a wall jet element.

FIG. 6 shows actuating element 12 as a curved plate-type element. In first rest position 26, only the drag force acts on actuating element 12. With increasing deflection of actuating element 12 from its rest position 26, the buoyant force acts additionally on convex surface 29, thus increasingly replacing the drag force. Intensification of the buoyant force is achieved by adding a wall jet element 28. The negative pressure generated between actuating element 12 and wall jet element 28 holds actuating element 12 in its second rest position 27. This favors the desired bistable characteristic of the unit comprising closure element and actuating element.

What is claimed is:

1. A muffler for pulsating gases, of internal combustion engines, said muffler comprising:

a housing into which an inlet conduit enters, from which at least one outlet conduit exits and which is divided by at least one partition wall into at least two chambers, the flow cross section of a flow path connecting at least one of two chambers and of an outlet conduit being variable by means of an adjustable closure element constructed as a pivotable throttle valve;

an actuating element acting on the closure element is disposed spaced to and downstream from the exit cross section of the inlet conduit;

wherein the actuating element comprises a movable plate-type element upon which the pulsating gas is incident; and wherein the throttle valve and the plate-type element are connected to one another by a shaft such that they pivot with one another.

2. A muffler according to claim 1, wherein the actuating element is connected via a gear mechanism to the closure element.

3. A muffler according to claim 1 further comprising a restoring device which exerts on the closure element a restoring force acting in the direction of reduction of the flow cross section.

4. A muffler according to claim 2, further comprising a restoring device, which exerts on the closure element a restoring force acting in the direction of reduction of the flow cross section.

5. A muffler according to claim 1 wherein the plate-type element is plant.

6. A muffler according to claim 1 wherein the plate-type element is convex.

7. A muffler according to claim 1 wherein the plate-type element is angled.

8. A muffler according to claim 1 wherein the stationary flow-deflecting elements are associated with the plate-type element.

* * * * *